US005405088A

United States Patent [19]

Gordon et al.

[11] Patent Number: 5,405,088

[45] Date of Patent: Apr. 11, 1995

[54] FUEL INJECTION NOZZLE FOR MOTOR VEHICLES

[75] Inventors: Uwe Gordon, Markgroeningen; Guenter Lewentz, Hemmingen; Detley Potz, Stuttgart, all of Germany

[73] Assignee: Robert Bosch GmbH, Stuttgart, Germany

[21] Appl. No.: 176,996

[22] Filed: Jan. 3, 1994

[30] Foreign Application Priority Data

Mar. 29, 1993 [DE] Germany ..... 43 10 154.2

[51] Int. Cl.[6] ..... B05B 1/32; F02M 61/00

[52] U.S. Cl. ..... 239/453; 239/533.12; 239/541

[58] Field of Search ..... 239/533.2–533.12, 239/584, 453, 456, 459, 541

[56] References Cited

U.S. PATENT DOCUMENTS

| | | | |
|---|---|---|---|
| 4,197,997 | 4/1980 | Wu et al. | 239/533.12 X |
| 4,693,424 | 9/1987 | Sczomak | 239/453 |
| 4,750,675 | 6/1988 | Sczomak | 239/453 |
| 4,958,771 | 9/1990 | Klomp | 239/533.12 X |
| 5,020,728 | 6/1991 | Linder et al. | 239/533.12 |
| 5,127,584 | 7/1992 | Sczomak | 239/533.11 |

FOREIGN PATENT DOCUMENTS

| | | | |
|---|---|---|---|
| 3221770 | 12/1983 | Germany | 239/533.12 |
| 3737896 | 5/1989 | Germany | 239/533.9 |
| 2096702 | 10/1982 | United Kingdom | 239/533.12 |
| 2113303 | 8/1983 | United Kingdom | F02M 61/18 |

*Primary Examiner*—Andres Kashnikow
*Assistant Examiner*—Lesley D. Morris
*Attorney, Agent, or Firm*—Edwin E. Greigg; Ronald E. Greigg

[57] ABSTRACT

A fuel injection nozzle for internal combustion engines having a nozzle body with a valve seat disposed on a side of the combustion chamber of the internal combustion engine and an outwardly opening needle valve with a closing head that has a closing cone that cooperates with the valve seat. At least one outwardly oriented injection hole is disposed in the closing head that is supplied with fuel via a supply conduit from a pressure chamber. The supply conduit is oriented axially with respect to the injection hole and changes over into this injection hole in a funnel shape. Its width corresponds approximately to the length of the injection hole. The injection hole and supply conduit extend at an acute angle a to the longitudinal axis of the closing head that is adapted to the combustion chamber of the internal combustion engine. The intake of the supply conduit is located in a face end of the closing head remote from the end on the side of the combustion chamber.

9 Claims, 3 Drawing Sheets

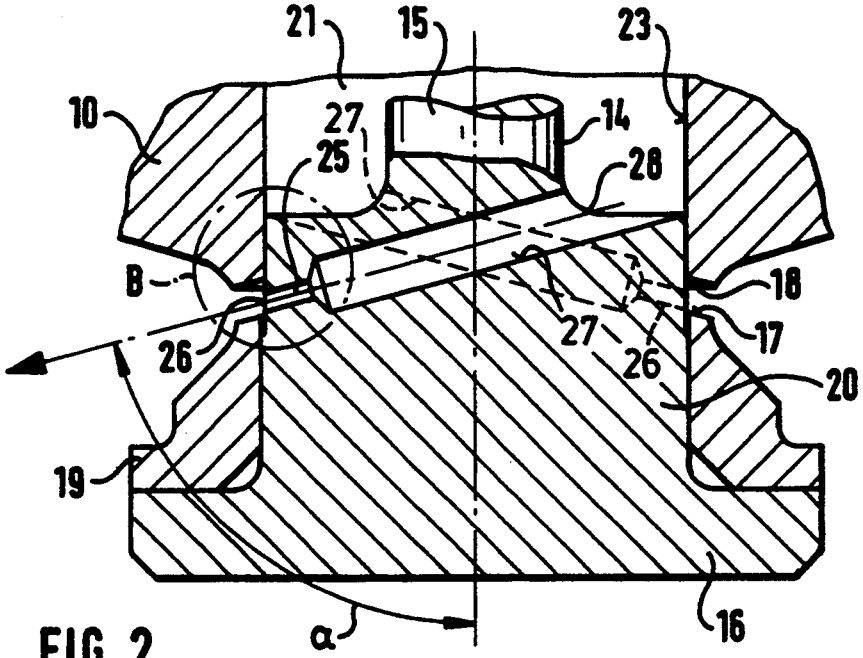
FIG. 2
FIG. 3
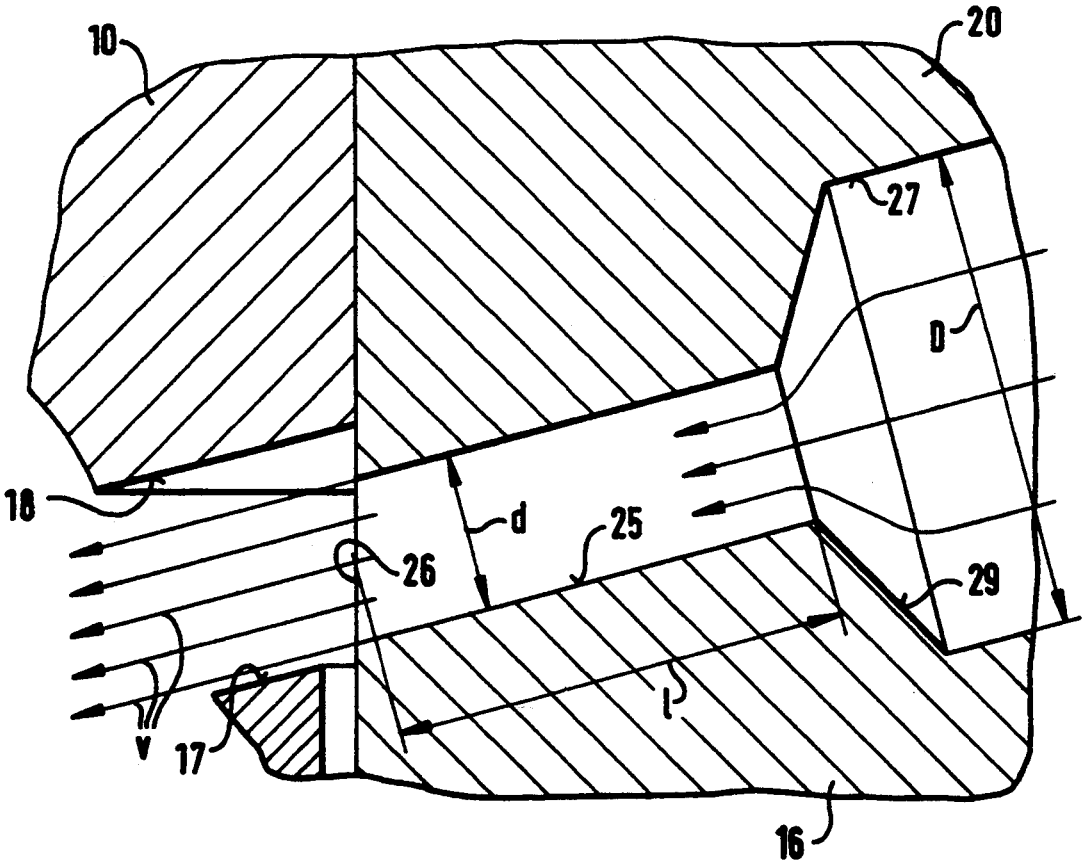

FUEL INJECTION NOZZLE FOR MOTOR VEHICLES

The invention is based on a fuel injection nozzle for motor vehicles as defined hereinafter.

BACKGROUND OF THE INVENTION

With a fuel injection nozzle known from German Published, Non-Examined Patent Application DE-OS 33 00 953, for example, the relatively short injection holes, embodied as blind bores, extend at a low conical angle in the closing head and terminate at the circumference of a cylindrical segment of the closing head that is enclosed by the nozzle body. Supply conduits, starting from a conical segment disposed in front of the cylindrical segment and extending at a steep angle in the closing head, terminate in the injection holes at right angles. Also, because the cross-section of a supply conduit is only slightly larger than that of the injection hole, a severe deflection of the flow occurs at the transition of the supply conduit into the injection hole, and a non-homogenous velocity distribution in the flow in the injection hole and also in its discharge opening occurs due to the varying influx and deflection conditions. An axial component of the supply conduit is also superimposed onto the flow in the injection hole; this component remains uncompensated in the short length of the injection hole, so that the fuel stream exiting the injection hole is diverted in the orientation of the injection hole in the direction of the axial component.

SUMMARY OF THE INVENTION

The fuel injection nozzle of the invention, has the advantage that the homogenization of the flow already forced in the wide supply conduit oriented on the same axis as the injection hole creates nearly identical influx conditions during the transition into the injection hole, so that a uniform velocity distribution occurs in the stream exit cross-section, and therefore leads to a uniform stream pattern. Added to this is that the conversion of the pressure energy into kinetic energy occurs directly at the relatively short injection hole, so that high-energy injection streams are formed that diffuse into fine droplets in the combustion chamber.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 2 shows a section A of the injection end of the fuel injection nozzle on the side of the combustion chamber, in accordance with FIG. 1, in section on an enlarged scale which illustrates a plurality of supply conduits; and FIG. 3 shows a section B of the region of the injection hole of the injection nozzle, in accordance with FIG. 2, in section and on an even larger scale;

DESCRIPTION OF THE PREFERRED EMBODIMENT

Figure 1:
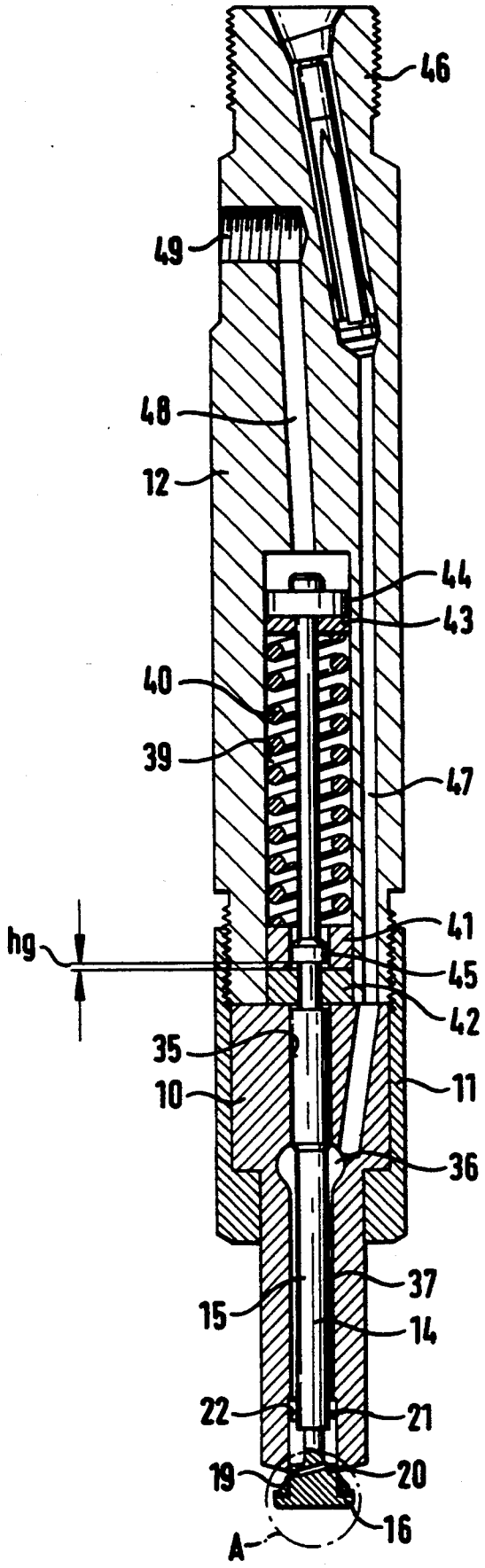
FIG. 1 shows a fuel injection nozzle in longitudinal section.

The fuel injection nozzle has a nozzle body 10 that is held tightly to a nozzle holder 12 via a union nut 11. A needle valve 15 is displaceably seated in the nozzle body 10 and supports a closing head 16 at the end on the side of the combustion chamber of the combustion engine. A ring 19 with a frustoconical valve cone 17 is fixedly placed on the end of the closing head 16 on the side of the combustion chamber at the combustion engine and cooperates with a valve seat 18 in the shape of a hollow cone on the nozzle body 10. The section of the closing head 16 that protrudes into the nozzle body 10, and is radially stepped with respect to the valve cone, is embodied as a piston valve 20 guided in a guide segment 23, near the valve seat 18, of a cylindrical bore 22 in the nozzle body 10 that forms a pressure chamber 21.

At least one injection hole 25 is disposed in the piston valve 10; its discharge opening 26 is located in the casing of the piston valve 20 and is only at a small distance or none at all from the valve cone 17, so that its exit cross-section is continuously cleared by the inner edge of the valve seat 18 during an opening stroke of the closing head 16 (FIGS. 2 and 3). The longitudinal axis of the injection hole 25 extends at a very acute angle a in relation to the axis of displacement of the needle valve 15 and the nozzle body 10. This angle a is adapted to the shape of the combustion chamber of the internal combustion engine. The length 1 of the injection hole 25 is within a range of two to four times its width d. Instead of a preferably circular cross-section, the injection hole 25 can have a different cross-section, such as an oval shaped, triangular or polygonal cross-section, depending on which cross-section is to be opened during a respective opening stroke.

The injection hole 25 is supplied with fuel from the pressure chamber 21, through a supply conduit 27 in the closing head 16. This supply conduit 27 preferably extends on exactly the same axis or, alternately, with only a slight deviation from the axis of extension of the injection hole 25. Its intake 28 is located in the face end of the closing head 16 facing the pressure chamber 21, or of the piston valve 20, next to the shaft 14 of the needle valve 15, which is connected at the center. The transition between the supply conduit 27 and the injection cross-section 25 is embodied as a funnel 29, for example, so that the pressure energy is converted into kinetic energy with a low loss. To ensure that the pressure conversion actually occurs directly at the injection cross-section, and not beforehand, in the supply conduit 27, its cross-section is larger by a minimum factor than the actual injection cross-section. The cross-section of the preferably circular supply conduit 27 can also differ from the circular cross-section and have a different cross-sectional shape that is adapted to the injection hole 25. The preferably straight-line supply conduit 27 can also be curved. With an alternative of this type, however, it is crucial that its end section changing over into the injection hole makes the tangential change into the injection hole with only a slight curvature.

Figure 4:
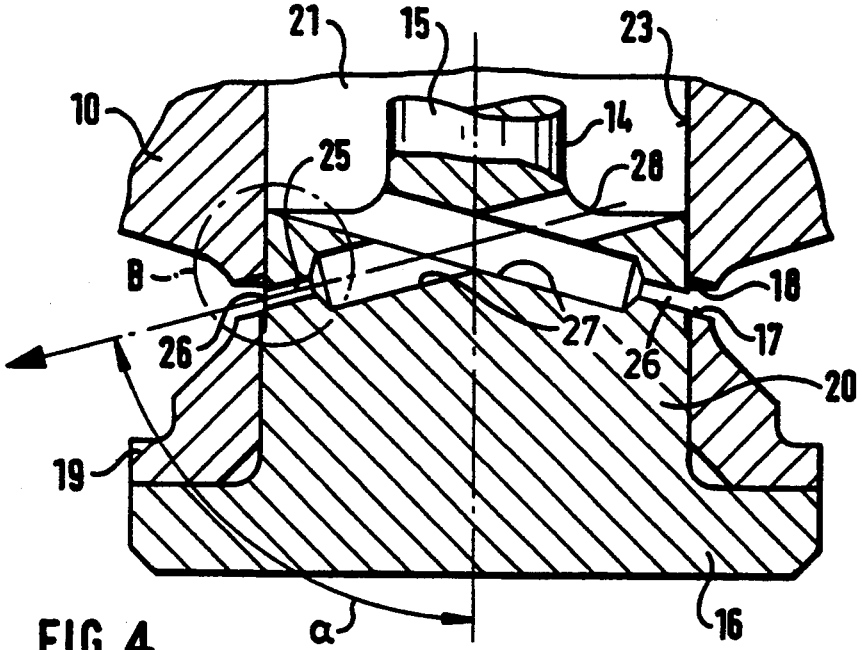
FIG. 4 shows a section A of the injection end of the fuel injection nozzle on the side of the combustion chamber, in accordance with FIG. 1, in section on an enlarged scale which illustrates crossing supply conduits.

For the sake of clarity, the closing head 16 of the above described exemplary embodiment of the fuel injection nozzle is represented in FIG. 2 with a plurality of injection holes 25 and a plurality of supply conduits 27. In practice, however, fuel injection nozzles with a plurality of injection holes are necessary as a rule that are distributed regularly or irregularly on a circle of the closing head and that also can have identical or different angles of injection. In such a case, the individual supply conduits can cross each other in the closing head 16 as shown in FIG. 4.

The needle valve 15 is displaceably seated in a guide bore 35 in the nozzle body 10, and a collection chamber 36 and an annular gap 37 connecting it to the pressure chamber 21 adjoin this bore downstream. In the resting position, the valve cone 17 of the closing head 16 of the needle valve 15 is pulled against the valve seat 18 on the nozzle body 10 by a closing spring 40 disposed in a spring chamber 39 in the nozzle holder 12. The closing spring 40 is supported via a spacing bushing 41 and a slotted stop disk 42 on the nozzle body 10, and the closing spring presses, via an equalizing disk 43, against a support ring 44 secured at one end of the needle valve 15. To limit the total stroke $h_g$ of the needle valve 15, the shaft of the needle valve 15 is stepped at the level of the stop disk 42 to form a stop collar 45 that is at a distance $h_g$ from the stop disk 42 in the closed position of the needle valve 15. A supply conduit 47 in the nozzle holder 12 and nozzle body 10 that starts from a connector 46 leads to the collection chamber 36 in the nozzle body 10. Moreover, an oil leakage conduit 48 connects the spring chamber 39 to a connection 49.

The fuel injection nozzle described operates in the following manner: between injections, the closing spring 40 presses the needle valve 15 with the valve cone 17 on the closing head 16 against the valve seat 18 on the nozzle body 10, wherein the discharge openings of the injection holes 25 are overlapped by the circumferential wall of the nozzle body 10 inside the guide section 23, and the sealing cone rests tightly against the valve seat 18. When fuel is conveyed under pressure through the supply conduit 47 into the collection chamber 36, and from there through the annular gap 37 into the pressure chamber 21, pressure builds up that acts on the piston valve 20 of the closing head 16. When a specific opening pressure has been reached at which the prestress of the closing spring 40, to which the force on the needle valve resulting from the gas pressure in the combustion chamber of the combustion engine must be added, is overcome, the needle valve 15 is displaced in the direction of flow. In the process, the valve cone 17 lifts from the valve seat 18 on the nozzle body 10, so that the discharge opening 26 of the injection hole(s) 25 is continuously cleared by the inner edge of the valve seat 18 on the nozzle body 10 as a function of the fuel conveying pressure. The needle stroke and injection cross-section are the result of the balance of respectively the force of the closing spring 40 and the hydraulic force at the piston valve 20. Fuel flows, in the form of bundled injection streams, through the open cross-section at the discharge opening of the injection holes 25, between the valve cone 17 and the valve seat 18 into the combustion chamber of the internal combustion engine.

When the discharge opening 26 of the injection hole 25 is completely or partly cleared, the pressure built up in the pressure chamber 21 and in the supply conduit 27 is converted into flow energy at the transition from the supply conduit 27 into the injection hole 25, so that a flow with a high velocity is generated in the injection hole 25. Because the relatively wide supply conduit 27 is disposed on the same axis as the injection hole 25, and therefore the same conditions predominate in the entire region of the transition, a flow already homogenized in the supply conduit 27 is also homogenous in the injection hole 25, so that the injection stream exiting the injection hole 25 has identical velocity vectors v and thus a uniform stream pattern over its cross-section. In an arrangement of a plurality of injection holes 25 and supply conduits 27 in the closing head 16 with a resulting crossing, a homogenous flow is established at the transition of the supply conduits into the injection holes, in the region of the supply conduits near the injection holes, despite the turbulence at the crossing, because a very high pressure predominates in the supply conduits and the flow is small.

When the pressure of the conveyed fuel decreases, the closing spring, supported by the combustion chamber pressure, pulls back the needle valve 15, and the injection holes 25 are first closed; then the valve cone 17 of the closing head 16 is again tightly sealed on the valve seat 18 of the nozzle body 10.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection nozzle for an internal combustion engine which has a combustion chamber, having a valve body in which a fuel supply conduit in a closing head is formed, and at whose end a valve seat is formed on a side of the combustion chamber of the combustion engine, and having a spring loaded needle valve displaceably seated inside the nozzle body, said needle valve has a closing head at an end on a side of the combustion chamber of the combustion engine that closes and cooperates with a valve seat on the nozzle body, said needle valve opens outwardly and is guided inside the nozzle body, at least one injection hole is formed in said closing head which is opened as a function of the needle stroke, as is a supply conduit connecting said at least one injection hole with the fuel supply, the supply conduit (27) in the closing head (16) has a significantly larger cross-section than the injection hole (25) and is oriented with a longitudinal extension essentially on a same longitudinal axis as that of the least one injection hole.

2. The fuel injection nozzle as defined by claim 1, in which an intake-side opening (28) of the supply conduit (27) is inclined toward the longitudinal axis of the needle valve (15) and is disposed in a face end of the closing head (16) remote from the combustion chamber of the combustion engine.

3. The fuel injection nozzle as defined by claim 1, in which a transition (29) from the supply conduit (27) into the injection hole (25) is embodied to be continuous.

4. The fuel injection nozzle as defined by claim 1, in which a plurality of crossing supply conduits (27) are disposed in the closing head.

5. The fuel injection nozzle as defined by claim 2, in which a plurality of non-crossing supply conduits (27) are disposed in the closing head.

6. The fuel injection nozzle as defined by claim 3, in which a plurality of non-crossing supply conduits (27) are disposed in the closing head.

7. The fuel injection nozzle as defined by claim 1, in which a plurality of non-crossing supply conduits (27) are disposed in the closing head (16).

8. The fuel injection nozzle as defined by claim 2, in which a plurality of non-crossing supply conduits (27) are disposed in the closing head (16).

9. The fuel injection nozzle as defined by claim 3, in which a plurality of non-crossing supply conduits (27) are disposed in the closing head (16).

* * * * *